US008821054B2

(12) United States Patent
Nakazawa et al.

(10) Patent No.: US 8,821,054 B2
(45) Date of Patent: Sep. 2, 2014

(54) PRINTER APPARATUS

(75) Inventors: Kenichiro Nakazawa, Nirasaki (JP); Yukihiro Nakajima, Kai (JP); Daisuke Kaneoya, Yamanashi-ken (JP)

(73) Assignee: Nisca Corporation, Minamikoma-gun, Yamanashi-ken (JP)

( * ) Notice: Subject to any disclaimer, the term of this patent is extended or adjusted under 35 U.S.C. 154(b) by 966 days.

(21) Appl. No.: 12/005,301

(22) Filed: Dec. 27, 2007

(65) Prior Publication Data

US 2008/0170902 A1 Jul. 17, 2008

(30) Foreign Application Priority Data

Jan. 17, 2007 (JP) ..... 2007-007714

(51) Int. Cl.
*B41J 11/58* (2006.01)
*B41J 13/10* (2006.01)

(52) U.S. Cl.
CPC ..... *B41J 13/103* (2013.01); *B41J 13/106* (2013.01)
USPC ..... 400/624; 400/693; 400/694

(58) Field of Classification Search
CPC ..... G03G 2215/0097; G03G 2215/00421; G03G 15/6538; G03G 15/6552
USPC ..... 400/624, 693, 694
See application file for complete search history.

(56) References Cited

U.S. PATENT DOCUMENTS

| | | | | | |
|---|---|---|---|---|---|
| 4,751,527 | A * | 6/1988 | Oda | 347/66 |
| 5,454,553 | A * | 10/1995 | Firl et al. | 271/4.04 |
| 5,536,093 | A * | 7/1996 | Tomoda et al. | 400/242 |
| 6,278,472 | B1 * | 8/2001 | Sasaki et al. | 347/175 |
| 6,443,642 | B1 * | 9/2002 | Luciano et al. | 400/88 |
| 6,732,687 | B2 * | 5/2004 | Djordjevic | 123/90.16 |
| 7,817,926 | B2 * | 10/2010 | Yano | 399/13 |
| 7,850,167 | B2 * | 12/2010 | Bluethgen et al. | 271/207 |
| 2001/0009625 | A1 * | 7/2001 | Tamehira et al. | 399/405 |
| 2001/0019349 | A1 * | 9/2001 | Kawakami | 347/108 |
| 2004/0114958 | A1 * | 6/2004 | Katsuyama et al. | 399/107 |
| 2006/0067716 | A1 * | 3/2006 | Yano | 399/13 |
| 2006/0075909 | A1 * | 4/2006 | Hoshi et al. | 101/114 |

FOREIGN PATENT DOCUMENTS

| | | | | |
|---|---|---|---|---|
| EP | 1 120 267 | | 8/2001 | |
| JP | S56-009758 | | 1/1981 | |
| JP | S58-154234 | | 10/1983 | |
| JP | 02025362 | A * | 1/1990 | B41J 29/06 |

* cited by examiner

*Primary Examiner* — David Banh
(74) *Attorney, Agent, or Firm* — Manabu Kanesaka

(57) ABSTRACT

A printer apparatus includes a supply unit to supply recording media, a recording unit to record information to the recording media, and a storage unit to store the recording media. A tray is formed in at least one of the supply unit and the storage unit and detachably connected to the apparatus to store a plurality of recording media in a stacked state. The apparatus includes a support surface for supporting a bottom surface of the tray, and at least one wall surface touching or opposing a side surface of the tray. An opening is defined by the bottom surface and the at least one wall surface to allow the tray to be detached from a direction within a predetermined angle of the side surface of the apparatus. A positioning device is disposed in at least one of the support surface and the wall surface for positioning the tray.

15 Claims, 12 Drawing Sheets

PRINTER APPARATUS

BACKGROUND OF THE INVENTION AND RELATED ART STATEMENT

The present invention generally relates to printer apparatuses. More particularly, the present invention relates to a printer apparatuses provided with a supply unit to supply one recording media at a time, a recording unit to record information to the recording media supplied from the supply unit; and a storage unit to store the recording media recorded at the recording unit.

Copiers having a drum to print characters and images to a sheet-shaped recording media (a sheet), and card issuing apparatuses having a print head to print characters and images to a card-shaped recording media (a card), are known in the art.

Generally, a tray is installed in a supply unit and/or a storage unit that is detachable from the apparatus unit to stack a plurality of recording media in a stack. Configurations of these kinds of trays are disclosed in Japanese Unexamined Patent Publication No. 56-9758 and Japanese Unexamined Utility Model Publication No. S58-154234. In the configurations, the tray is guided by guide members such as rails or the like with one direction for pulling, and can be mounted or removed in one direction from the front of the apparatus or from the side.

It is to be noted that, because an operator issues printing instructions, and must know the status of a printer apparatus, the printer apparatus has an operating panel that has an operating unit and a display unit; the operating panel is installed in the apparatus.

However, the apparatus setup direction and the direction for operator access to the apparatus are limited on apparatuses provided with the type of tray and operating panel described above. Also, if the tray is incorrectly inserted, it can strike the guide members such as rails and the like and damage the rails or the tray.

It is therefore an object of the present invention to provide a printer apparatus that has freedom in the direction of its setup and is free of guide members such as rails and the like used to install the tray. According to the present invention, the printer apparatus has a support surface that supports a bottom surface of the tray; at least one wall surface that touches or opposes a side surface of the tray; and an opening that allows the tray to be detached from any direction within a predetermined angle of the side surface of the apparatus unit. Because positioning means, that position the tray where it can hand over recording media to the apparatus, is disposed in the support surface and/or the wall surface so that the tray can be detached from any direction of the opening continuously opened within a predetermined angle on the apparatus side surface, and because the detaching direction of the tray can be any direction, it is possible to eliminate guide members such as rails.

Further objects and advantages of the invention will be apparent from the following description of the invention.

SUMMARY OF THE INVENTION

To accomplish the above object, a printer apparatus according to the present invention is provided. The printer apparatus has a supply unit that supplies recording media one at a time, a recording unit that records information to the recording media supplied from the supply unit, and a storage unit that stores the recording media recorded at the recording unit, at least one of the supply unit and the storage unit has a tray which is detachable from the apparatus and is capable of storing a plurality of recording media in a stacked state. The apparatus has a support surface that supports a bottom surface of the tray, and an opening demarcated by at least one wall surface that touches or opposes a side surface of the tray to allow the tray to be detached from any direction within a predetermined angle of the side surface of the apparatus. Also, a positioning means is provided, the positioning means is disposed in the support surface and/or the wall surface to position the tray where it is possible to hand over the recording medium to the apparatus.

With the present invention, the apparatus has a support surface that supports the bottom surface of the tray, and an opening demarcated by at least one wall surface that touches or opposes the side surface of the tray to allow the tray to be detached from any direction within a predetermined angle of the apparatus side. Therefore, the tray is detachable from any direction of the continuously open opening at a predetermined angle of the side of the apparatus. The positioning means is disposed in the support surface and side wall to position the tray at a position that allows it to hand over recording media to the apparatus so the tray can be positioned and stored in the opening using (a) positioning means disposed in the wall surface and support surface, (b) positioning means disposed in the side surface and wall surface, (c) a plurality of positioning means disposed in the support surface, (d) a plurality of positioning means disposed in the wall surface, and (e) positioning means disposed in the support surface and positioning means disposed in the wall surface.

Further, according to the present invention, the printer apparatus has a support surface that supports a bottom surface of the tray, at least one wall surface that touches or opposes a side surface of the tray, and an opening that allows the tray to be detached from any direction within a predetermined angle of the side surface of the apparatus unit. It is possible to eliminate guide members such as rails because, positioning means that position the tray where it can hand over recording media to the apparatus is disposed in the support surface and/or the wall surface. This structure allows the tray to be detached from any direction of the continuously opened opening within a predetermined angle on the apparatus side surface.

Further, in the present invention, the tray is locked at a position by the positioning means where it is able to hand over the recording media to the apparatus. The tray is prevented from rotating because its side walls touch the wall surfaces. Also, it is preferable to lock the tray at a position where it can hand over recording media with the apparatus by positioning means disposed in a plurality of locations. Also, the support surface, preferably, is substantially flat, and the wall surface may be a vertical surface, that is, perpendicular to the support surface. Also, it is acceptable that one of the positioning means or tray has a convex portion, and the other has a concave portion. These concave and convex portions are configured to mate, thereby locking the tray with the positioning means. The convex portion has a retreated position and a projected position, and is constantly urged by a spring toward the projected position. The convex portion can be a spherical shape.

Also, it is acceptable that one of the positioning means or tray has a magnet, and the other has a material having a magnetic property to be attracted to that magnet. These magnet and material with a magnetic property are attracted, thereby locking the tray with the positioning means. Still further, if the apparatus is equipped with an operation panel that rotates within a predetermined angle, the operation panel can be revolved, thereby allowing an operator to freely access the tray and operation panel. This expands the range of directions to setup the apparatus, and improves operator convenience.

BRIEF DESCRIPTION OF THE DRAWINGS

FIGS. 6A to 6C are sectional views showing operations of the locking mechanism, wherein FIG. 6A shows a state prior to the leading edge around the concave portion at the back surface side of the bottom of the discharge tray touching a projecting member, FIG. 6B shows the projecting member pushed downward by the leading edge portion around the concave portion and positioned at its retreated position and FIG. 6C shows the convex portion and the concave portion in a mated state;

FIGS. 12A and 12B are plan views of the horizontal support surface and locking mechanism of a printer apparatus of another embodiment to which the present invention is applied, wherein FIG. 12A is an embodiment with one locking mechanism disposed in a center of the horizontal support surface, and one vertical engaging surface and FIG. 12B is an embodiment with two locking mechanism disposed in the horizontal support surface.

DETAILED DESCRIPTION OF PREFERRED EMBODIMENTS

The following will now explain an embodiment of the present invention applied to a printer apparatus having a function to print record characters and images to a card-shaped recording medium (hereinafter simply referred to as a card), and a function to magnetically record to a magnetic strip on the card, with reference to the drawings provided.

The printer apparatus of this embodiment is connected to a host apparatus (for example, a host computer such as a personal computer or the like) via an interface, not shown. The host apparatus provides instructions such as recording operations and the like by sending print recording data and magnetic recording data to the printer apparatus. Note that as described below, the printer apparatus has an operation panel. Therefore, in addition to the recording operation instructions sent from the host apparatus, recording operation instructions can also be designated using this operation panel. Generally, an image input device such as a scanner or the like that reads an original recorded image, an input device such as a keyboard and mouse and the like that inputs instructions and data to the host apparatus, and a monitor such as a liquid crystal display that displays data generated using the host apparatus, are connected to the host apparatus.

Figure 1:
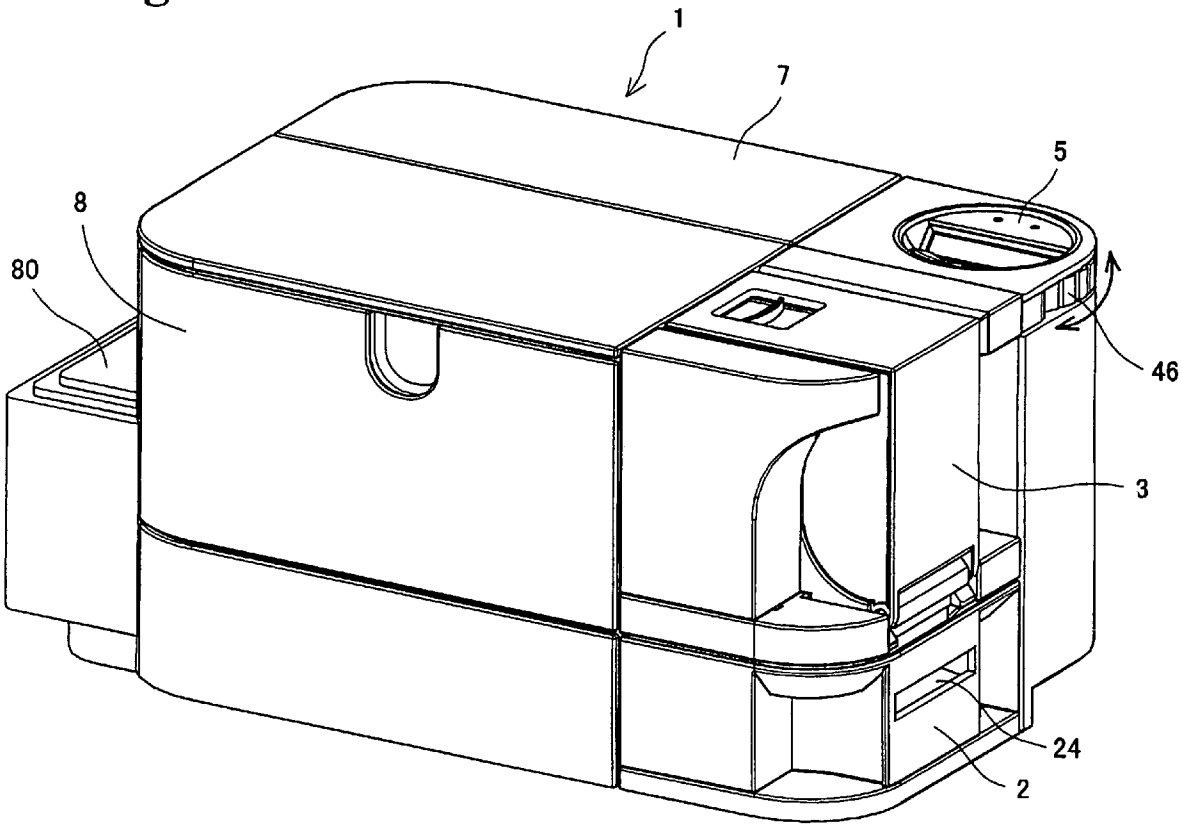
FIG. 1 shows an external perspective view of a printer apparatus of an embodiment that applies the present invention.

As shown in FIG. 1, the printer apparatus 1 according to this embodiment has a supply tray 3 detachably mounted to a casing 7 at one side thereof, that can store in a stacked shape (approximately 100 cards) a plurality of blank cards prior to recording, a discharge tray 2 detachably mounted to the casing 7 at one side thereof, that can store recorded cards in an oblique state (approximately 30 cards) disposed below the supply tray 3, and an operation panel 5 that has on an upper portion positioned adjacent to the supply tray 3 at one side of the casing 7, for making various settings such as for the print and magnetic recording processes.

A card discharge outlet 24 formed as an opening to discharge recorded cards to outside of the apparatus is provided at one portion of the discharge tray 2 so that the cards can be discharged from the apparatus when the discharge tray 2 is full. Also, an opening cover 8 is provided at one surface of the printer apparatus 1 to allow access to inside the apparatus to detach a cartridge 59 (see FIG. 9) that houses an ink ribbon R used in print recording. The opening cover 8 composes a portion of the casing 7. At another side of the casing 7, a magnetic encoder unit 80 is disposed with a portion thereof projecting from the casing 7 opposing the supply tray 3 and the discharge tray 2.

Figure 2:
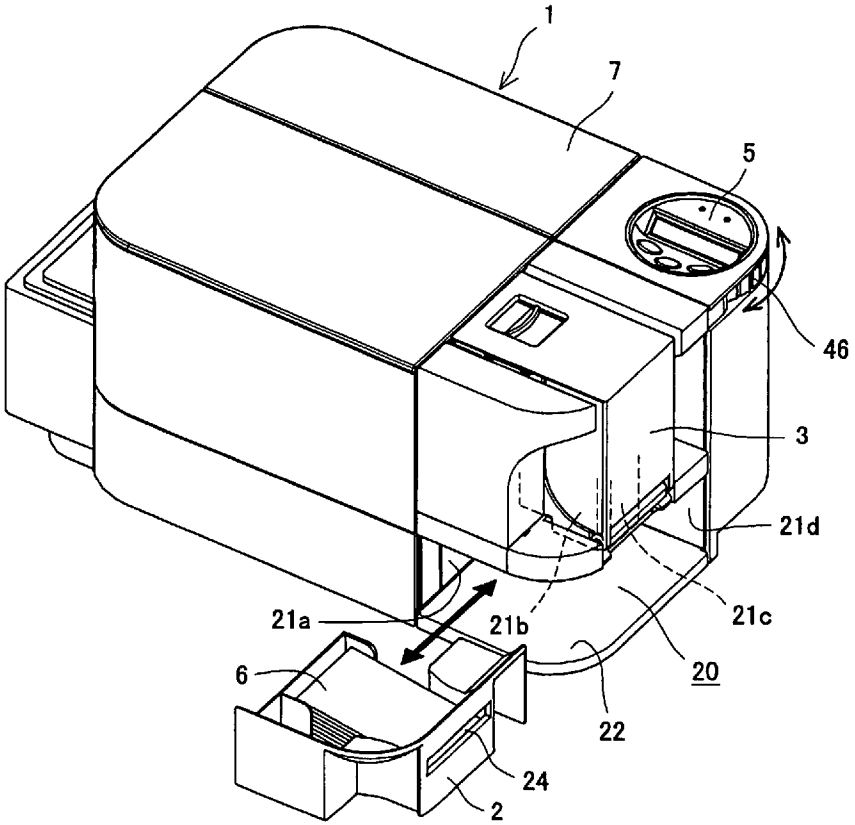
FIG. 2 is a perspective view showing the discharge tray pulled out to the front of the printer apparatus of an embodiment.

As shown in FIG. 2, an opening 20 is formed in the casing 7 (apparatus body) to store the discharge tray 2. The opening 20 is formed by the substantially flat and smooth horizontal support surface 22 that supports the bottom surface of the discharge tray 2 disposed in the casing 7, and the vertical engaging surfaces 21*a*, 21*b*, 21*c*, 21*d* as wall surfaces standing in directions perpendicular (intersecting) to the horizontal support surface 22.

The vertical engaging surfaces 21*a*, 21*c* stand in directions perpendicular to the opening cover 8, and vertical engaging surfaces 21*b*, 21*d* stand parallel to the opening cover 8 (a direction perpendicular to the vertical engaging surfaces 21*a*, 21*c*). Also, no surfaces opposing the vertical engaging surfaces 21*a* to 21*d* are formed. Specifically, there are no brace members or guide members at the boundaries of the front side (the side where the opening cover 8 is disposed) and right side surface of the opening 20.

Figure 3:
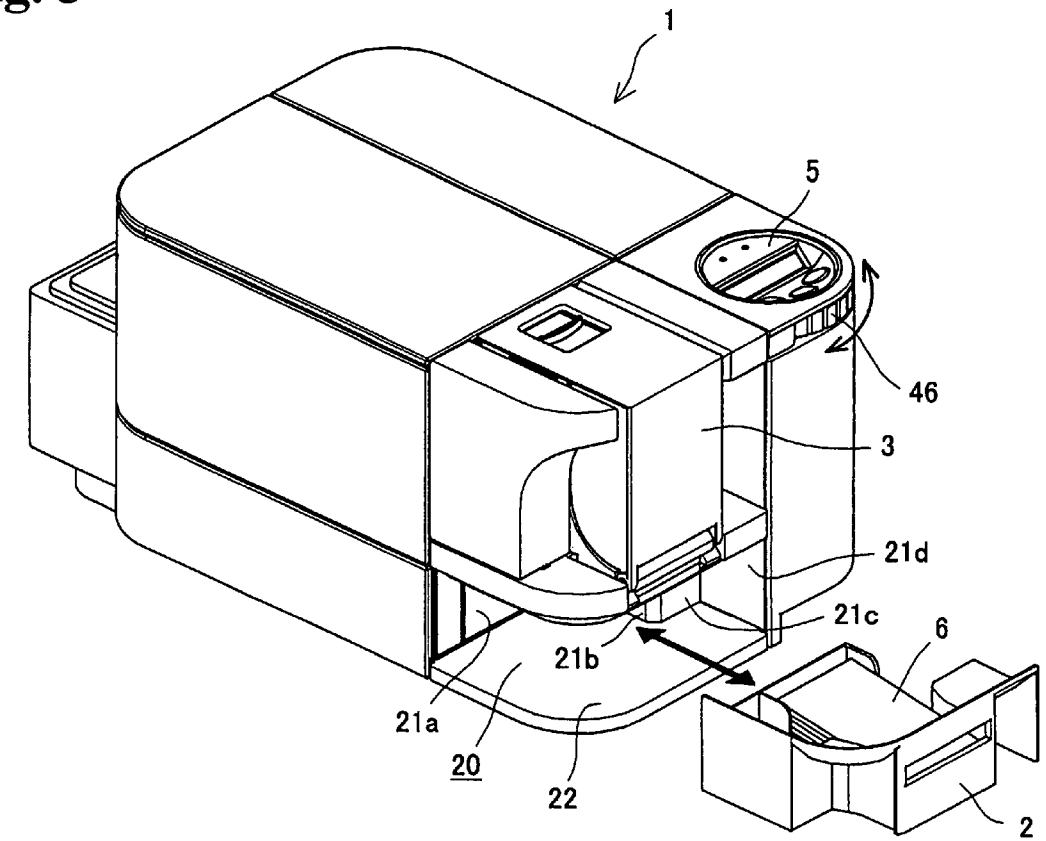
FIG. 3 is a perspective view showing the discharge tray pulled out to the side of the printer apparatus of the embodiment.
Figure 4:
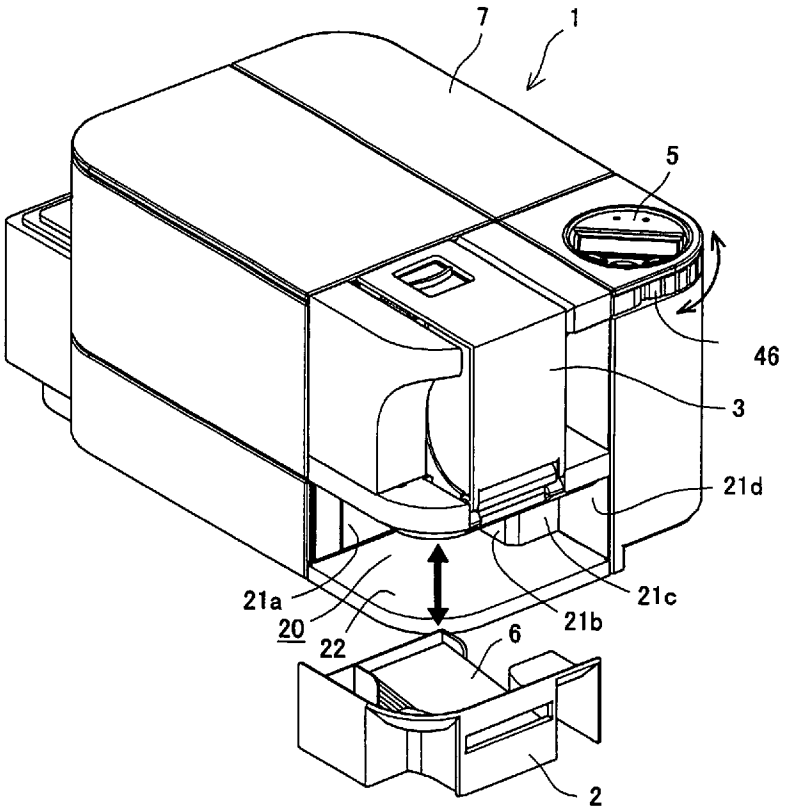
FIG. 4 is a perspective view showing the discharge tray pulled out to a direction between the front and the side of the printer apparatus of an embodiment.

Therefore, the opening 20 is continuously open within a predetermined angle (in this embodiment, 90°) demarcated mainly by the vertical engaging surfaces 21*a* and 21*d*. For the above reason, the printer apparatus has a structure that allows the discharge tray 2 to be detached from the apparatus not only toward the conventional front side (direction of the arrow in FIG. 2) and the side surface direction (direction of the arrow in FIG. 3), but also in a direction that is between the front side and side surface directions. Therefore, as shown in FIG. 4, the discharge tray 2 is detachable from an oblique direction (with regard to the printer apparatus).

Figure 5:
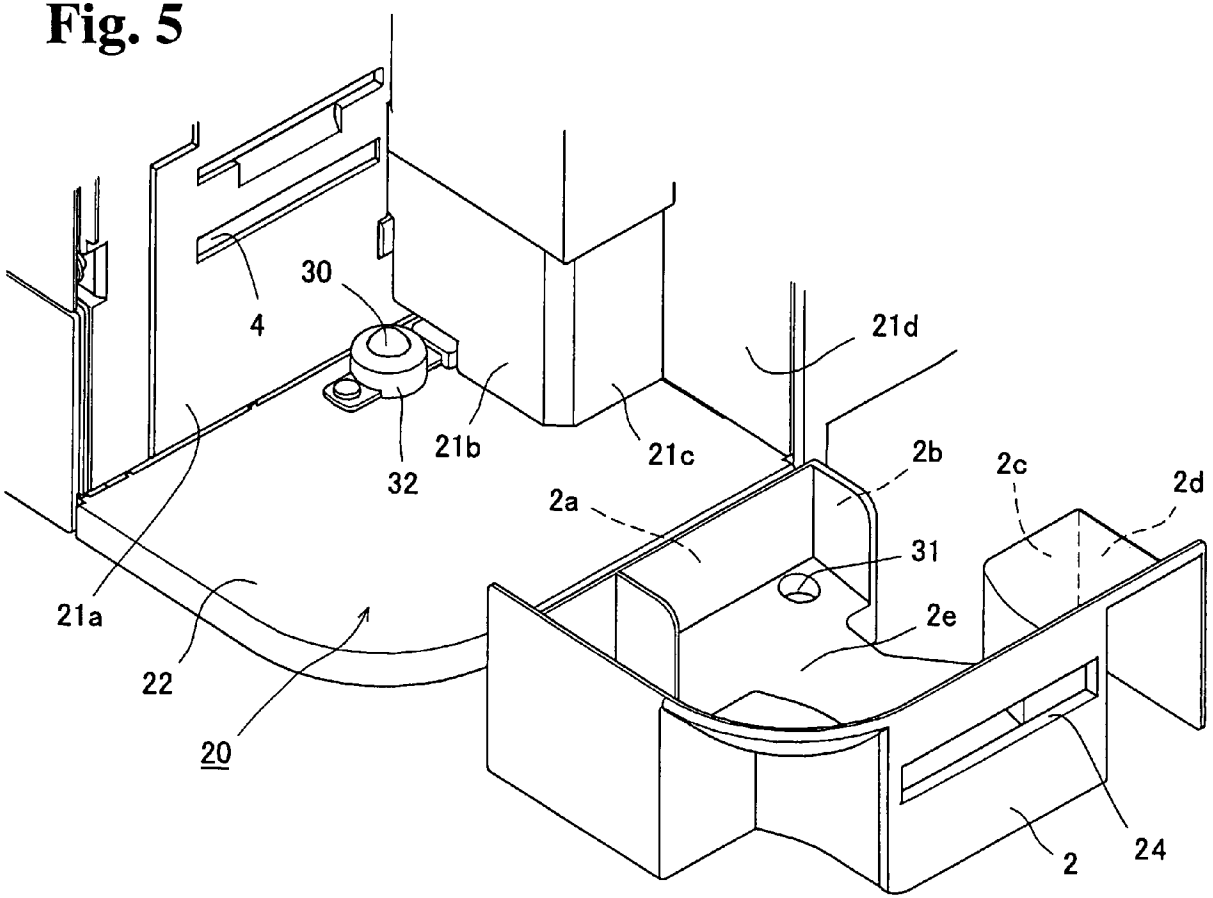
FIG. 5 is a perspective view showing a relationship between a horizontal support surface, and a vertical engaging surface that form an opening in the printer apparatus of this embodiment, a locking mechanism disposed on the horizontal support surface, and the discharge outlet formed in the vertical engaging surface and the discharge tray.

Further, as shown in FIG. 5, the discharge tray 2 has a touching surface 2*a* standing in a vertical direction from the bottom surface 2*e*, and a touching surface 2*b* standing in a direction perpendicular to the touching surface 2*a*. The touching surfaces 2*a* and 2*b* touch the vertical engaging surfaces 21*a* and 21*b* of the casing 7, respectively, when the discharge tray 2 is installed in the opening 20. The card discharge outlet 24 is formed to have a rectangular shape (a slot-shape) in a surface that opposes the touching surface 2*a* of the discharge tray 2. Also, the discharge tray 2 has a touching surface 2*c* standing in the same direction as the touching surface 2*a* and a side surface 2*d* standing in a direction perpendicular to the touching surface 2*c*, provided to join toward the apparatus. The touching surfaces 2*c* and 2*d* abut the vertical engaging surfaces 21*c* and 21*d* of the casing 7, respectively, when the discharge tray 2 is installed in the opening 20.

Therefore, when it is installed, the bottom surface 2*e* touches the horizontal support surface 22, and the discharge tray 2 is guided to its installation position in the opening 20 by the touching surface 2*a* (which has the largest surface area) touching the vertical engaging surface 21*a*. Similarly, the touching surfaces 2*b*, 2*c*, and 2*d* are guided to the installation position by touching the vertical engaging surfaces 21*b*, 21*c*, and 21*d*. The installation position is a fixed position where cards that have completed the printing and magnetic recording processes are discharged from the discharge outlet 4 formed to a rectangular shape in the casing 7 and stored in the tray. The discharge tray 2 is fixed at its installation position by a locking mechanism disposed in a corner of the horizontal support surface 22 on the apparatus side. As shown in FIGS. 5 and 6A to 6C, the locking mechanism is composed of a convex member 30, a spring 34 and a bracket 32.

Figure 6A:
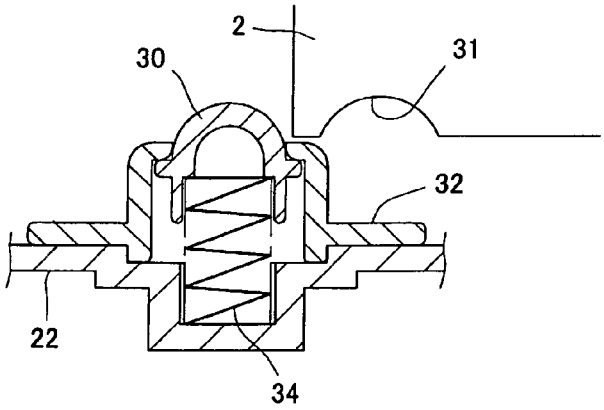
Figure 6B:
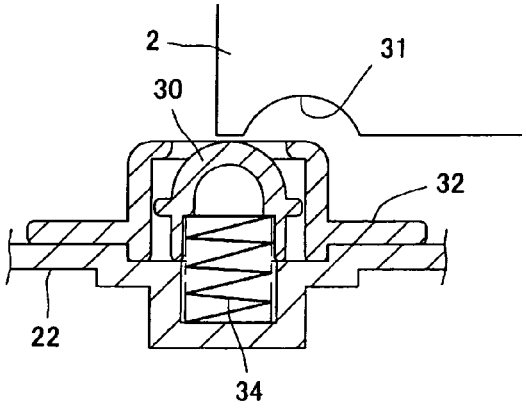
Figure 6C:
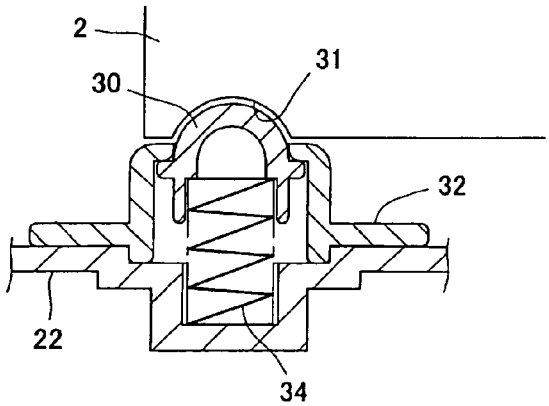

The convex member 30 is semi-spherical having a hollow sphere. A flange portion is in the center, and at the underside there is cylinder that houses the top of the spring 34. The bracket 32 has a cylindrical shape. At its top, the bracket 32 has an engaging portion that engages the flange of the convex member 30 to control the engaging position in an upward direction of the convex member 30 urged by the spring 34. At an underside of the bracket 32, there is a fastening portion that fastens to the horizontal support surface 22. The fastening portion of the bracket 32 is fastened to the horizontal support surface 22 by a screw. A cylindrical portion that is one level lower is formed at the position where the bracket 32 is disposed on the horizontal support surface 22, and the bottom portion of the spring is housed in that cylindrical portion. As shown in FIGS. 6A to 6C, the horizontal support surface 22 has a first level that supports the legs of the bracket 32 that extend further downward from the fastening portion of the bracket 32, and a second level that forms a bottom surface of that cylindrical portion. Therefore, the spring 34 is stored in the space formed by the convex member 30, the bracket 32 and the horizontal support surface 22.

The convex member 30 is normally at its projected position because of the urging force from the spring 34 (see FIG. 6A). However, when a force (pressure) that is strong than the urging force of the spring is applied to the semi-spherical portion, the top of the semi-spherical portion is pushed downward to the abutting portion of the bracket so that the convex member 30 is positioned at its retreated position (See FIG. 6B). It is to be noted that that at the retreated position, the cylinder of the convex member 30 touches the first level of the horizontal support surface 22 so that it will not be pushed any further downward from the retreated position.

Conversely, a concave portion 31 that mates with the semi-spherical portion of the convex member 30 is formed in the discharge tray 2. Therefore, when installing the discharge tray 2, first the leading edge around the concave portion 31 on the back surface of the bottom portion 2*e* of the discharge tray 2 touches the convex member 30 (see FIG. 6A). As the discharge tray 2 is pushed in the direction toward the inside of the opening 20, the convex member 30 is pushed downward by the leading edge around the concave portion 31 and is positioned at its retreated position (see FIG. 6B). The convex member 30 is constantly urged toward its projected position by the spring 34. Therefore, when the leading edge, around the concave portion 31, passes over the convex member 30 and the concave portion 31 is positioned over the convex member 30, the convex member 30 projects back to its projected position, thereby causing the convex member 30 and concave portion 31 to mate (See FIG. 6C). The convex member 30 is semi-spherical and hence the discharge tray 2 can be locked from any direction rather than only one direction. It is to be noted that, to detach the discharge tray 2, the opposite procedures are applied.

Further, because the convex member 30 that composes the locking mechanism is a semi-spherical shaped, the discharge tray 2 can rotate (pivot) around the locking mechanism. Rotation of the discharge tray 2 is prevented by the touching surfaces 2*a* to 2*d* of the discharge tray 2 touching the vertical engaging surfaces 21*a* to 21*d*. This causes the discharge tray 2 to be positioned properly and fixed at its installation position.

Figure 7:
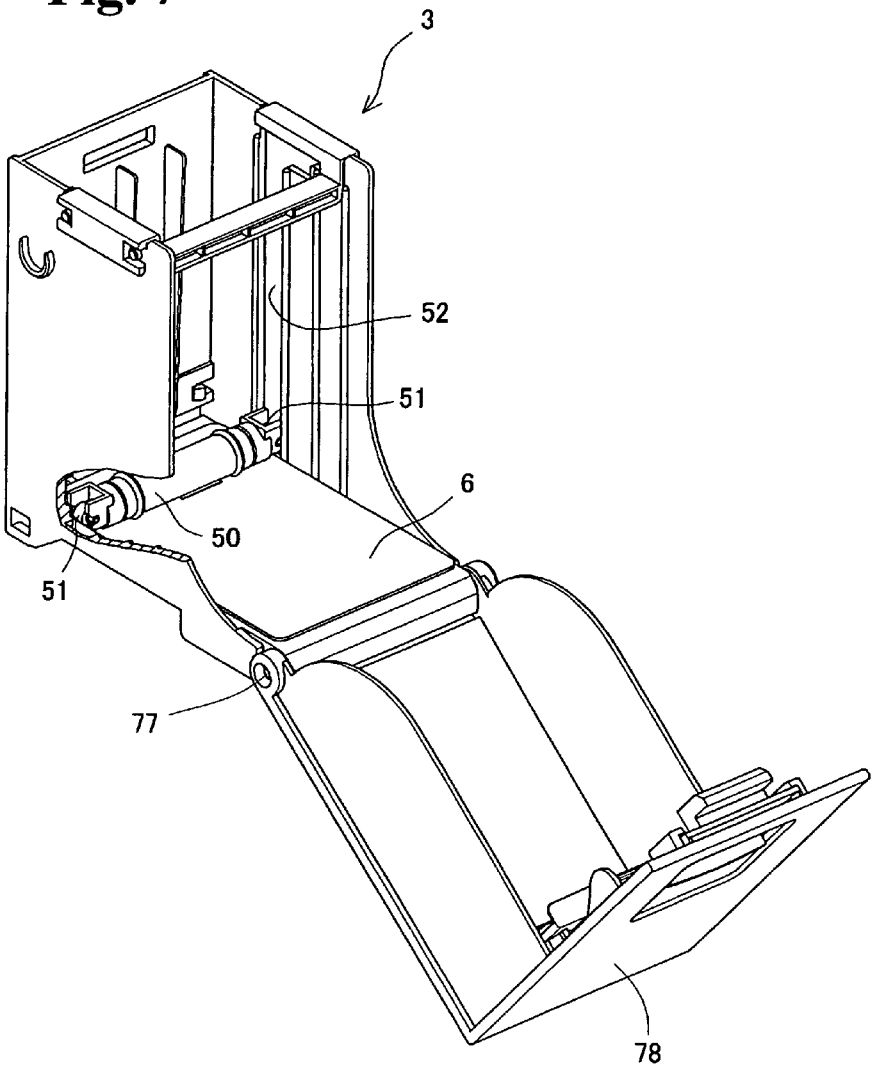
FIG. 7 is a partially broken external perspective view showing the cover of the discharge tray installed in the printer apparatus of the embodiment opened.

As shown in FIG. 7, the supply tray 3 has a weight roller 50 that applies weight to the stacked blank cards (card 6) from above and supplies one card 6 at a time toward the apparatus by cooperating with a supply roller 11, described below (see FIG. 9). A central portion of the weight roller 50 that touches the card 6 is covered by a flexible member such as rubber. Rollers 51 are provided at both ends of the weight roller 50. The weight roller 50 is able to slide in up and down directions along guide channels 52 formed in the wall surfaces of the supply tray 3. This enables the weight roller 50 to change its position according to the number of cards 6 (the thickness of the stack of cards 6) that are stacked in the supply tray 3. The guide channels 52 are formed to have two vertical ribs. A top portion of one vertical rib is connected to a horizontal rib. Therefore, it is possible to slide the weight roller 50 in a horizontal direction at the top portion of the guide channels 52 to be positioned at the top portion (to be fastened at the horizontal rib) of the supply tray 3. It is to be noted that, in FIG. 7, a side surface of the supply tray 3 is shown to be cut away to enable the rollers 50 to be visible. However, it is actually covered in the same way as the opposing side.

Further, an opening cover 78 is rotatably mounted to a leading edge of the bottom surface of the supply tray 3 via a shaft 77. Therefore, the supply tray 3 is composed mainly of the three members of a card storage portion that has the weight roller 50, the opening cover 78 and the shaft 77 that connects those parts. The opening cover 78 has a locking portion. The locking portion engages a catching part formed in the card storage portion. To make it easy for the operator to open the supply tray 3, a handle that includes a notch is provided in the opening cover 78.

To fill the supply tray 3 with the cards 6, the operator will grip the handle and rotate the opening cover 78 around the shaft 77 in the state shown in FIG. 1 thereby opening the supply tray 3. (See the state shown in FIG. 7). If the supply tray 3 is filled all at once with a large volume of the cards 6, the weight roller 50 can be fastened at the top portion of the supply tray 3 to allow a thick stack of the cards. Therefore, the supply tray (filling work) can be handled efficiently. In such a case, after filling the supply tray 3 with a large volume of the cards 6, the weight roller 50 can be slid and returned into the guide channels 52 and continue to function as a weight. (This means the weight roller 50 is slid from the position where it is resting at the horizontal rib and returned to a position where it can slide in up and down directions.)

Conversely, when only a small volume of cards are charged to the supply tray 3, the weight roller 50 can be slid in up and down directions along the guide channels 52 because of the rollers 51. Therefore, cards can be inserted in between cards 6 stacked in the supply tray 3 and the weight roller 50 that is touching the cards 6. The central portion of the weight roller 50 that touches the cards 6 is covered with a flexible member. This prevents the weight roller 50 from causing damage to the surface of the inserted cards 6 caused by the sliding contact of the weight roller 50 when it rotates.

Further, an opening is formed in the casing 7 (apparatus body) to detachably store the supply tray 3. The supply tray 3 is fastened to its installation position in the casing via the opening by being positioned by three vertical surfaces that touch three side surfaces of the supply tray 3 and a support member extending to the supply tray 3 from casing 7 to supports the bottom portion of the supply tray 3. The installation position is a fixed position allowing cards 6 stacked in the supply tray 3 to be supplied one at a time to the apparatus via a card supply opening (see FIG. 9) formed in the casing 7.

Figure 8:
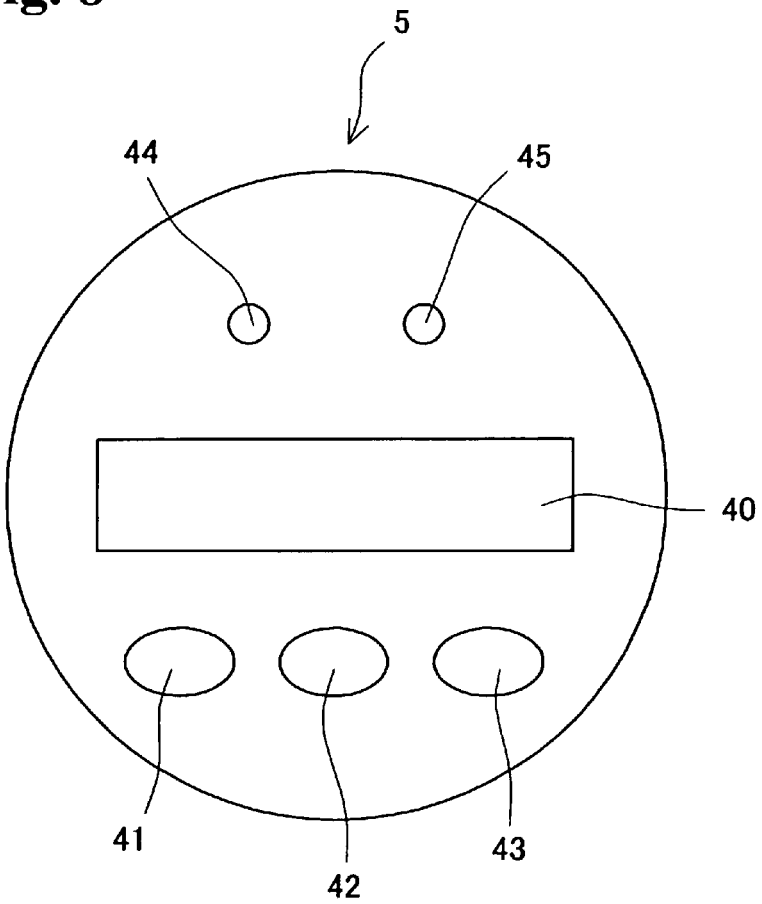
FIG. 8 is a plan view of an operating panel.

As shown in FIG. 8, the operation panel 5 is composed of a display unit 40 that displays operating menus of the printer apparatus 1, a menu button 41 to allow selection of operating menus, a clear button 42 to restart operations after an error has been cancelled (by confirmation by an operator), an execution button to execute the operating menu displayed on the display unit 40, a red LED 44 that lights or flashes when an error has occurred or the opening cover 8 is open, and a blue LED 45 that lights or flashes when the printer apparatus 1 is normal or operating. The operation panel is flat and circular, and fits in the casing 7.

As shown in FIG. 1, the operation panel 5 can be rotated within a predetermined angle (for example 90°) by rotating a dial-type knob 46 disposed in a side of the apparatus.

Figure 9:
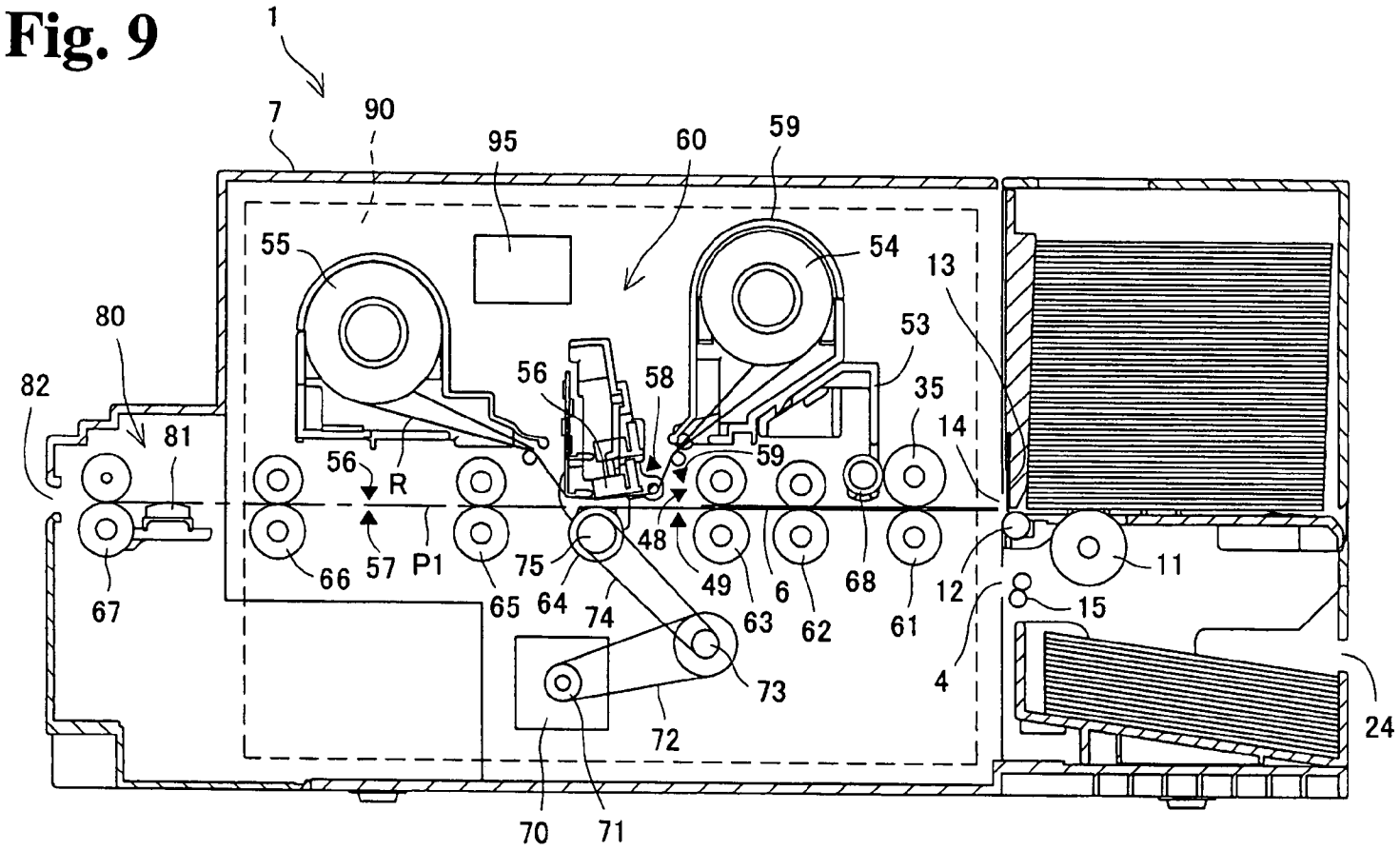
FIG. 9 is a schematic sectional view showing a card prior to a recording process being conveyed into the printer apparatus of the embodiment.
Figure 10:
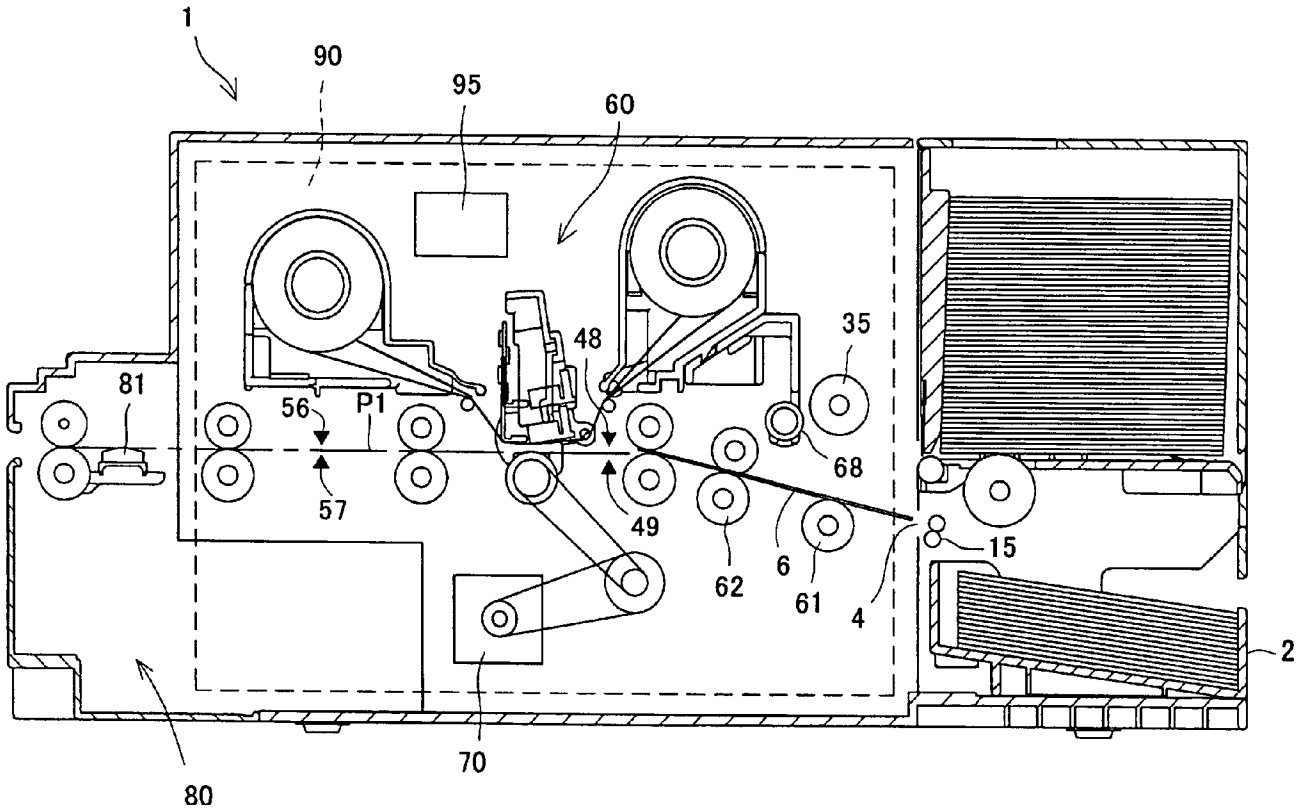
FIG. 10 is a schematic sectional view of the card after the recording process, being discharged in a printer apparatus of the embodiment.

The following will now explain each composing element inside the printer apparatus 1 with reference to FIGS. 9 and 10. FIG. 9 shows a blank card prior to being recorded, supplied from the supply tray 3 and conveyed toward a printing unit 60. FIG. 9 further shows a cleaning roller 35 touching a surface of the conveyed card 6 to clean the printing surface of the card 6. On the other hand, FIG. 10 shows the card 6 recorded at the printing unit 60 and the magnetic encoder unit 80 being conveyed toward the discharge tray 2.

The supply roller 11 that is rotatably driven by a motor, not shown, is disposed in a side of the apparatus (printer apparatus 1). The printer apparatus 1 has a supply roller 12 and a separating gate 13 composed of a plate-shaped member to allow only one of the cards 6 to pass into the apparatus when the bottommost (lowest level card 6) card 6 stacked in the supply tray 3 is fed into the apparatus by the supply roller 11. The supplied card 6 passes the supply roller 12 and the separating gate 13 and is guided to a card supply opening 14 provided at one side of the casing 7 to link with the supply tray 3.

On the other hand, recorded cards 6 discharged from the discharge outlet 4 formed below the card supply opening 14 at one side of the casing 7, are sequentially discharged and stored in the discharge tray 2 by a discharge roller 15 (see FIG. 10).

Further, the discharge roller 15 is fastened to the printer apparatus 1. A motor, not shown, that rotatably drives the supply roller 11 also drives the discharge roller 15, but in the case where the supply roller 11 is rotating in a direction to supply a card 6 from the supply tray 3, the reverse drive of the motor, not shown, rotatably drives to discharge the card 6 to the discharge tray 2. Specifically, the supply roller 11 and discharge roller 15 are rotated by the forward and reverse drives of the motor, not shown, but because a one-way clutch, not shown, is installed in the supply roller 11, it is possible to rotate only in the card supply direction. In this embodiment, the supply operation for cards 6 that have not been recorded and the discharge operation for recorded cards 6 do not occur at the same time, so the rotation for discharging the card 6 by the discharge roller 15 and the rotation in a direction opposite thereto are not hindered.

The card 6 supplied from the card supply opening 14 is conveyed along the substantially horizontal path P1 being sequentially handed over to conveyance rollers 61, 62 and 63 having driving force transmitted from the conveyance drive motor 70, described below. The conveyance rollers 62 and 63 are composed of a pair of rollers having a drive roller and a follower roller. (Hereinafter, unless a explanation is provided, the explanation will focus only on the drive roller, omitting an explanation of the follower roller of the pair of rollers.)

Further, at an opposite side of the conveyance roller 61, the cleaning roller 35 is positioned to advance to and retreat from the card conveyance path P1 to oppose the conveyance roller 61. When the cleaning roller 35 is advanced to above the card conveyance path P1 to touch the conveying card 6 (see the state shown in FIG. 9), the card 6 is gripped between the cleaning roller 31 and the conveyance roller 61 that has drive force, thereby removing foreign matter such as dust and dirt from the print surface to be printed at the printing unit 60.

When the cleaning roller 35 advances toward the card conveyance path P1 which is where the roller operates, the cleaning roller 35 is positioned to touch the surface of a roller-shaped cleaner 68 positioned at a predetermined position away from the card conveyance path P1 adjacent to the cleaning roller 35. The roller-shaped cleaner 68 is rotatably mounted to a support member 53 which is detachably installed at a predetermined position of a cartridge 59. The cartridge 59 houses an ink ribbon R as a portion of the printing unit 60.

At a downstream side of the conveyance roller 63 in the direction of card conveyance, the printing unit 60, to print records predetermined characters and images to a surface of the card 6, is located.

The printing unit 60 of this embodiment adopts the configuration of a thermal transfer type printer. This unit has a thermal head 56 provided to advance and retreat with regard to a platen roller 64 located at a printing position on the card conveyance path P1. The ink ribbon R having a plurality of colors of an ink layer Y (yellow), M (magenta), C (cyan), and Bk (black) and the like repeated sequentially on its surface interposes the platen roller 64 and the thermal head 56.

Further, while thermally transfer-recording information such as characters or images and the like to the card 6 moving along the card conveyance path P1, the ink ribbon R is supplied from the ribbon supply reel 54 and conveyed at the same speed as the conveyance speed of the card 6 to the leading end of the thermal head 56 while touching substantially the entire surface and is taken up by a take-up ribbon reel 55. The ribbon supply reel 54 and the ribbon take-up reel 55 are rotatably driven by a motor, not shown. The ink ribbon R interposes the thermal head 56 and the card 6 top surface. The ink ribbon R presses against the thermal head 56 while heating elements in the thermal head 51 are selectively operated to print predetermined characters and images to the card 6. A plurality of guide shafts, and a transmissive type sensor composed of a light-emitting element 58 and a light-receiving element 59 that detects the ink layer Bk (black) to align the top of a predetermined ink layer (in this embodiment, the ink layer Y) are provided in the ink ribbon R conveyance path.

A transmissive type sensor (hereinafter referred to as a first card detection sensor) composed of a light-emitting element 48 and a light-receiving element 49 that detects a leading edge and a trailing edge of the card 6 in the direction of conveyance conveyed along the conveyance path P1 is disposed in an upstream side (the conveyance roller 63 side) of the thermal head 56 in the direction of conveyance of the card.

A conveyance drive motor 70 composed of a stepping motor capable of both forward and reverse drives is disposed below the printing unit 60 to rotatably drive the series of conveyance rollers 61, 62 and 63 and the platen roller 64. A pulley 71 mounted on the rotating shaft of the conveyance drive motor 70 transmits the rotational driving force of the conveyance drive motor 70 to the pulley 73 by the belt 72, and drive is transmitted to the platen roller 64 by the belt 74 one end thereof trained on the pulley 73, via the pulley 75 disposed on the rotating shaft of the platen roller 64.

A plurality of gears, not shown, is disposed on the rotating shafts of the platen roller 64 and the conveyance rollers 61, 62 and 63, and between each of the rollers. Rotational driving force transmitted to the platen roller 64 is, in turn, transmitted to each of the conveyance rollers 61, 62 and 63 via the plurality of gears.

Further, a nip roller 65, which nips the card 6 when print recording thereto by the printing unit 60, has a function to convey the card 6 to a downstream side of the platen roller 64 in the conveyance direction (the ribbon take-up reel 55 side). The nip roller 65 is disposed along the conveyance path P1. Further downstream of the nip roller 45 in the direction of card conveyance, a feed roller 66 is disposed to convey the card 6 along the same conveyance path P1. A transmissive type sensor (hereinafter referred to as a second card detection sensor) composed of a light-emitting element 56 and a light-receiving element 57 that detects a leading edge of the card C in the direction of conveyance conveyed along the conveyance path P1 is disposed in substantially the center of the nip roller 65 and the feed roller 66.

Gears, not shown, are mounted on the nip roller 65 and the feed roller 66. Also, a plurality of gears is disposed between the platen roller 64 and nip roller 65, and the nip roller 65 and the feed roller 66. The plurality of gears, not shown, mutually mesh to transmit the rotational drive force from the conveyance drive motor 70 to the nip roller 66 and the feed roller 66 by branching from the gear disposed on the rotating shaft of the platen roller 64 via drive force transmission mechanism including the pulleys, belts and plurality of gears, not shown.

The magnetic encoder unit 80 is disposed adjacent to the feed roller 66 downstream of the printing unit 60 in the direction of card conveyance. A reciprocating (self-propelled) magnetic head 81 that scans along the conveyance path P1 is disposed in the magnetic encoder unit 80 to magnetically record to the magnetic strip of the card 6 held in a stopped state by the nip roller 65 and the feed roller 66.

A card conveyance outlet 82 formed as an opening to discharge the card 6 conveyed along the conveyance path P1 to outside of the apparatus is provided at one portion of the magnetic encoder unit 80. Specifically, the card conveyance outlet 82 is provided on an extended line of the conveyance path P1 at the other side of the casing 7 opposite to the card supply opening 14. Therefore, it is possible to convey in a cleaning card to clean the plurality of rollers disposed in the card conveyance path P1 and outside the apparatus via the card conveyance outlet 82 after cleaning the rollers.

A conveyance roller 67 that conveys the card 6 toward the card conveyance outlet 82 and out of the card conveyance outlet 82 is disposed in the magnetic encoder unit 80. There is no drive source provided in the magnetic encoder unit 80 to rotatably drive the conveyance roller 67, but a plurality of gears, not shown, are provided and linked between the conveyance out roller 67 and feed roller 66 to transmit rotational driving force transmitted to the feed roller to the conveyance roller 67.

Therefore, the printer apparatus 1 has a configuration that provides the card supply opening 14, the printing unit 60 and the magnetic encoder unit 80 along a substantially horizontal card conveyance path P1 connected from the supply unit 3.

As is clearly shown in the drawing, the magnetic encoder unit 80 has a unit shape a portion thereof fit into the apparatus. The conveyance drive motor 70 is disposed under the printing unit 60 and between the magnetic encoder unit 80 and the moving mechanism 110, explained below, (see FIG. 12) that moves the conveyance rollers 61 and 62 to the first and second positions.

Figure 11:
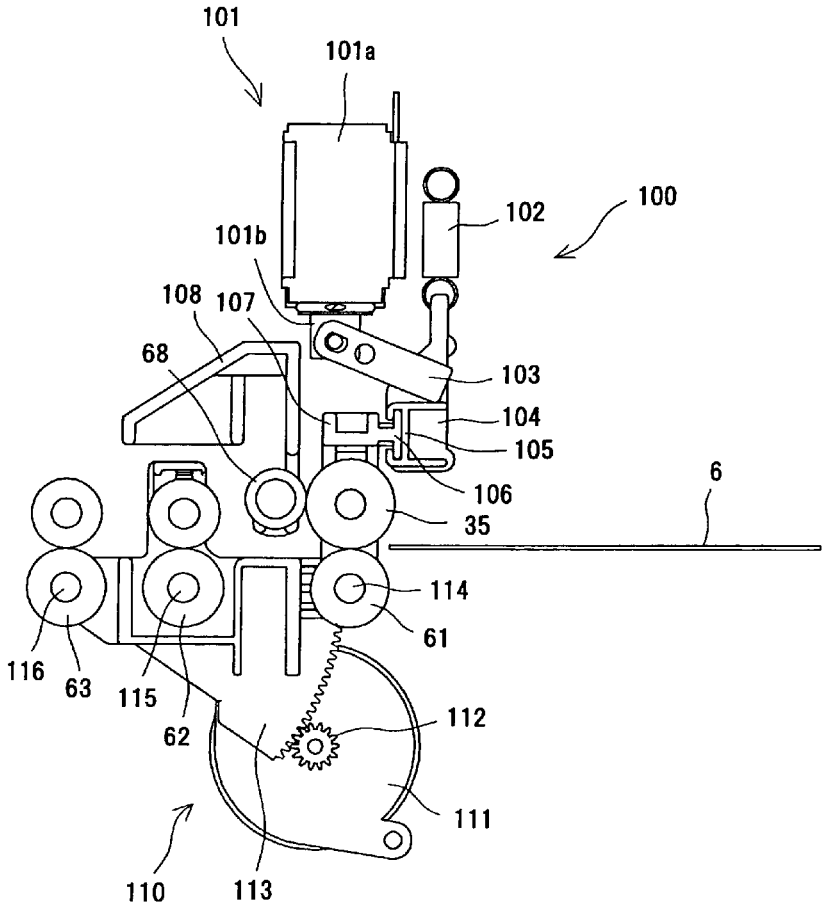
FIG. 11 is an expanded view of a portion of a moving mechanism and a card cleaning mechanism.

The following will now explain the card cleaning mechanism 100 and the moving mechanism 110 with reference to FIG. 11. FIG. 11 shows the card 6 received from the card supply opening 14 and the state just prior to the card 6 being nipped by the cleaning roller 35 and the conveyance roller 61.

The card cleaning mechanism 100 has an actuator 101 composed of a solenoid 101*a* to enable the cleaning roller 35 to move between an operating position where it touches the card 6 (surface contact) and the roller-shaped cleaner 68 by advancing into the card conveyance path P1, and a retreated position that is a home position separated from the conveyance path P1, and a plunger 101*b* that advances and retreats by the drive switch (ON/OFF) of the solenoid 101*a*.

A lever member 103, one end thereof rotatably mounted to an end of the plunger 101*b*, is provided. An engaging member 104 that engages the other end of the lever member 103 is also provided. One end of the engaging member 104 is hooked to a tension spring 102 fastened to a predetermined position inside the apparatus, urging force from the tension spring 102 constantly urges the engaging member 104 upward.

The card cleaning mechanism 100 has a holder 107 that holds the cleaning roller 35, and has an integrated configuration where a convex portion 106 formed on a portion of the holder 107 is fit into a concave portion 105 formed on a portion of the engaging member 104. The card cleaning mechanism 100 has a configuration that includes a roller-shaped cleaner 68 rotatably mounted to a support member 108 detachably installed at a predetermined position of a cartridge 59 that houses an ink ribbon R as a portion of the printing unit 60.

Further, when the solenoid 101*a* of the drive unit 101 is driven (drive ON), the lever member 103 pushes the engaging member 104 downward thereby indirectly pushing the holder 107 that holds the cleaning roller 35 downward where the cleaning roller 35 is positioned at the operating position.

As shown in FIG. 11, the moving mechanism 110 has a stepping motor 111 capable of forward and reverse drives, a motor gear 112 mounted on the rotating shaft of the stepping motor 111, and a geared bracket 113 that has a geared portion that meshes with the motor gear 112. Roller shafts 114, 115, and 116 that support the conveyance rollers 61, 62 and 63 are held by the geared bracket 113.

Since, the geared bracket 113 is provided to rotate around the roller shaft 116 of the conveyance rollers 63, the moving mechanism 110 allows the conveyance rollers 61 and 62 to move between the first position (a position where the conveyance rollers 61 and 62 form a substantially level card conveyance path, a home position, see FIG. 9) and the second position (a position where the conveyance rollers 61 and 62 form an oblique conveyance path see FIG. 10).

As shown in FIGS. 9 and 10, the printer apparatus 1 has a control unit 95 that controls overall operations of the printer apparatus 1 and a power unit 90 that converts commercial alternating current into direct current to drive and operate each of the mechanisms and control unit.

The control unit 95 comprises the microcomputer (hereinafter referred to as the microcomputer) that controls the overall processes of the printer apparatus 1. The microcomputer is composed of a CPU that operates at a high-speed clock as a central processing unit, a ROM written with basic control operations (programs and program data) of the printer apparatus 1, and RAM as the CPU work area, and internal busses connecting these.

Further, external busses are connected to the microcomputer. An interface, not shown, that communicates with the host apparatus, and a buffer memory, that temporarily stores print recording data to be printed on the card 6, and magnetic data that should be magnetically recorded in the magnetic strip on the card 6, are connected to the external busses.

A sensor control unit that controls signals from each sensor, an actuator control unit that controls the motor driver and the like that sends the drive pulse of each motor and drive power, a thermal head control unit that controls the thermal energy of the thermal head 56, an operation display unit that controls the operation panel 5, and the magnetic encoder unit 80 are connected to the external busses. The sensor control unit is connected to first and second sensors, and other sensors, not shown, such as an empty sensor and jam detection sensor, the actuator control unit is connected to the conveyance drive motor 70, the stepping motor 111, and another motor, not shown, and the actuator. The thermal head control unit is connected to the thermal head 56 and the operation display control unit is connected to the operation panel 5.

The power unit 90 supplies operating and drive power to the control unit 95, the thermal head 56, the operating panel 5 and the magnetic encoder unit 80.

The following will now explain the operations of the printer apparatus 1 according to this embodiment, and the microcomputer CPU (hereinafter referred to simply as the CPU) of the control unit 95.

When power is charged to the control unit 95, the CPU reads programs and program data stored in ROM (and expands to RAM) and conducts an initializing process that operates each mechanism. Specifically, in the initializing process, the connections of each of the control units of the sensor control unit connected to the microcomputer via the external busses and that composes the control unit 95, and of the magnetic encoder unit 80 are checked. Then a decision is made based on signals from the sensor control unit whether each composing unit is at its home position. If, each composing unit are not at their home positions, they are moved to their home positions. If, based on the signals of the sensor control unit, each composing element does not move to its home position after a plurality number of repeated attempts to return them to their home positions, the host apparatus is notified and the red LED 44 is lit via the operation control display unit.

Also, in the initializing process, it is determined whether a card is stored in the supply tray 3 based on signals from the sensor unit (the empty sensor). If there is no card, in the same way as described above, the host apparatus is notified and the red LED is lit. The system then idles until a card is stored in the supply tray 3 and the clear button 42 is pressed. The blue LED 45 of the operation panel 5 flashes during the initialization process and the recording process and lights when the system is idle.

A printer driver installed in the host apparatus determines various parameters to control the recording operation at the printer apparatus 1, based on recording instructions specified by an operator, and then generates print recording data to record to the card 6 and magnetic recording data using the recording instructions. The recording instructions are sent to the printer apparatus 1. Parameter values for the recording control instructions, image data and character data attained by disassembling print recording data into the color components of Y, M, C and Bk and magnetic recording data are stored in the buffer memory of the control unit 95. Note that with this embodiment, data is disassembled into its color components (the original data is R, G, B) at the host apparatus and that is converted from R, G, B to Y, M, C at the printer apparatus 1 and used as the image data. Bk data extracted at the host apparatus is used as Bk data in the same way at the printer apparatus 1 to be character data.

Further, the CPU reads the recording control instruction (parameter values) stored in the buffer memory to control each mechanism in the following way according to the parameter values and program and program data expanded to RAM.

Initially, the actuator 101 (solenoid 101*a*) is driven (turned ON) via the actuator control unit to move the cleaning roller 35 from its retreated position (home position) to the operating position shown in FIG. 9 to prepare to receive the card 6. The moving mechanism 110 positions the conveyance rollers 61 and 62 at the first position (home position) to form a substantially level card conveyance path. (See the States Shown in FIGS. 9 and 11.)

Next, the CPU operates the conveyance drive motor 70, via the actuator control unit, to drive each of the rollers disposed on the card conveyance path P1 via the drive transmission mechanism and forward drives a motor, not shown, to rotatably drive the supply roller 11 via the actuator control unit. This conveys the lowermost card 6 of the supply tray 3 between the supply roller 12 and the separating gate 13 and into the casing 7 via the card supply opening 14. The printing surface of the card 6 is cleaned by the cleaning roller 35 and the card 6 is conveyed along the card conveyance path P1 toward the card conveyance outlet 82 (See FIG. 9.). Further, when the trailing edge of the card 6 is detected by the first card detection sensor, the CPU uses the card trailing edge detection as a trigger to stop (turn OFF) the drive of the actuator 101 (solenoid 101*a*). The cleaning roller 35 is freed by a pressing action of the lever member 103 and is moved from the operating position to the retreated position which is the home position shown.

The card 6 is conveyed by the conveyance drive motor 70 over the card conveyance path P1 toward the card conveyance outlet 82 until both ends of the card 6 are at a position where they are nipped by the feed roller 66 and the nip roller 65. The CPU stops the conveyance drive motor 70 after the card leading edge detection from the second card detection sensor when a number of pulses of the conveyance drive motor 70 reaches a predetermined value. This stops and holds the card 6 with both edges in a nipped state by the feed roller 66 and the nip roller 65. The card 6 is then in a state where magnetic recording data can be written to the magnetic strip by the magnetic head 81 of the magnetic encoder unit 80.

Further, the CPU drives the direct current motor with the encoder, not shown, to move the magnetic head 81 from its home position to the operating position to write information to the magnetic strip on the card 6, and pressingly touches the magnetic head 81 against the magnetic strip on the card 6. Further, the CPU outputs magnetic recording data stored in the buffer memory to the magnetic encoder unit 80 via the external bus, and drives the direct current motor having an encoder, not shown, thereby moving the magnetic head 81 within the necessary region over the entire region from one edge to the other edge on the magnetic strip on the card 6 to record the magnetic recording information on the magnetic strip.

When the process to write the magnetic recording information to the magnetic strip on the card C has been completed, the CPU stops the direct current motor equipped with an encoder, not shown, and reverses its drive to read the magnetic recording information written to the magnetic strip on the card 6. Thus verifying whether the magnetic recording data stored in the buffer memory matches the magnetic recording data recorded in the magnetic strip on the card 6. (This is a check that the data was written correctly.) When this verification process is completed, the magnetic head 81 returns to its home position.

The CPU notifies the host apparatus and lights the red LED 44 when the information is verified to have been written incorrectly. When the operator presses down the clear button 42, the conveyance drive motor 70 drives a predetermined number of pulses (in the forward direction) to convey the card 6 to outside of the apparatus via the card conveyance outlet 82. Further, a new card 6 is supplied from the supply tray 3. In the same way, the magnetic encoder unit 80 writes magnetic recording data to the magnetic strip on the new card 6 and verifies that it is correctly written.

In a case where there is no problem in the results of the verification from the microcomputer of the magnetic encoder unit 80 (when magnetic recording data is correctly written to the magnetic strip on the card 6), the CPU drives the conveyance drive motor 70 in reverse. This conveys the card 6 stopped with both edges nipped by the nip roller 65 and the feed roller 46 in a reverse direction to the card supply opening 14 along the card conveyance path P1. While the card 6 is being conveyed in the reverse direction, the trailing edge of the card 6 is detected by the first card detection sensor. The conveyance drive motor 70 continues to drive in the reverse direction for a predetermined number of pulses and then stops its drive. This causes latter half of the card 6 in the conveyance direction to be stopped and held in a nipped state by the conveyance rollers 62 and 63, and the half-way portion from the trailing edge of the card 6 in the conveyance direction to be supported by the conveyance roller 61. (See FIG. 9)

The CPU drives a motor, not shown, causing the ink ribbon R of the cartridge 59 to be taken up at the ribbon take-up reel 55. The CPU uses the time that the transmissive sensor composed of the light-emitting element 58 and light-receiving element 59 detects the edge of the ink layer Bk (black) (when the light-receiving element 59 detects a switch from a non-transmissive state of the light from the light-emitting element 58 caused by the ink layer Bk to a transmissive state), as a trigger to drive the motor, not shown, further a predetermined number of steps to set the top of the ink ribbon so that the leading edge of the ink layer Y (yellow) is positioned at the thermal head 56 and platen roller 64 position.

Further, the CPU drives the conveyance drive motor 70 in the forward direction to convey the card 6 toward the card conveyance outlet 82 over the card conveyance path P1 and at the same time verify the position of the leading edge of the card 6 using the first card detection sensor and prints predetermined characters and images on the surface of the card 6 according to the print recording data using the printing unit 60. Specifically, the thermal head 56 presses against the card 6 surface with the ink ribbon R (the ink layer Y portion) interposed therebetween and selectively activates heating elements of the thermal head according to image data of the color Y (image data whose Y component was converted from the RGB data). This directly transfers the thermal transfer ink component of Y (yellow) coated on the ink ribbon R to the surface of the card 6.

The backside of the card 6 is supported by the platen roller 64, but initially it is nippingly conveyed by the conveyance rollers 62 and 63 toward the card conveyance outlet 82 over the card conveyance path P1. The leading edge of the card C is nippingly conveyed by the nip roller 65 and the trailing edge of the card C is nippingly conveyed by the conveyance roller 63, and finally it is nippingly conveyed by the nip roller 65 (while the backside of the trailing edge of the card C is supported by the platen roller 64). The CPU checks the position of the trailing edge of the card 6 with the first card detection sensor, and continues to drive the conveyance drive motor 70 in the forward direction for a predetermined number of pulses and then the drive of the conveyance drive motor 70 is stopped.

Further, the CPU drives the conveyance drive motor 70 in reverse to convey the card 6 in reverse along the card conveyance path P1 to the card supply opening 14. The card 6 is stopped and held with the back half in the conveyance direction in a nipped state by the conveyance rollers 62 and 63 and the front half in the conveyance direction supported by the conveyance roller 61. The drive of the conveyance drive motor 70 is stopped. (See FIG. 9) During this time, the CPU drives a motor, not shown, to slightly wrap the ink ribbon R of the cartridge 59 to the ribbon take-up reel 55 so that the leading edge of the ink layer M (magenta) is positioned at the thermal head 56 and platen roller 64 position. Next, the CPU drives the conveyance drive motor 70 in the forward direction to convey the card 6 along the card conveyance path P1 toward the card conveyance outlet 82 and directly transfers the thermal transfer ink component of the ink layer M (magenta) coated on the ink ribbon R to the surface of the card 6. Similarly, the CPU directly transfers the thermal transfer ink components of the ink layers C (cyan) and Bk (black) coated on the ink ribbon R to the surface of the card 6 using the printing unit 60. This forms a color image on the surface of the card 6 using the colors of Y, M, C and Bk.

Further, the CPU conveys the card 6 toward the discharge outlet 4. Specifically, when the conveyance drive motor 70 is driven in reverse, the card 6 is conveyed along the card conveyance path P1 in reverse toward the card supply opening 14. As shown in FIG. 9, while sequentially print recording multiple colors onto the print surface of the card 6 using the printing unit 60, the conveyance rollers 61 and 62 are kept at the first position positioned to form a substantially level card conveyance path when the card 6 is being conveyed in reverse to the card supply opening 14. However, when the card 6 has completed the predetermined recording processes and is being conveyed toward the card discharge outlet 4, using the point where the first card detection sensor detects the trailing edge of the card 6 being conveyed in reverse over the card conveyance path P1, or when using the detection of the trailing edge of the card 6 as a trigger and the card 6 is conveyed further a predetermined number of pulses, the CPU controls the drive of the stepping motor 111 so the moving mechanism 110 (drive from the stepping motor 111) moves the conveyance rollers 61 and 62 to the second position positioned where they form an oblique card conveyance path (see the state in FIG. 10), and drives a motor, not shown, in reverse to rotatably drive the supply roller 11 and rotatably drives the discharge roller 15.

With the above-mentioned processes, the card 6 will either be stored in the discharge tray 2 via the discharge outlet 4, or it is discharged from the card discharge outlet 24 to outside the apparatus (when the discharge tray 2 is full of cards). Note that when the card is discharged as shown in FIG. 10, the cleaning roller 35 is positioned at its retreated position that is its home position separated from the card conveyance path P1.

Further, at the point when the CPU either stores the card 6 in the discharge tray 2 or discharges it from the card discharge outlet 24, the reverse drives of the conveyance drive motor 70 and the motor, not shown, are stopped. Note that the CPU drives the stepping motor 111 again (rotatably driven in an opposite direction) at the predetermined timing when the discharge operation of the card 6 to the discharge tray 2 has been completed, to recover the conveyance rollers 61 and 62 from the second position positioned to form an oblique card conveyance path to the first position positioned to form a substantially level card conveyance path. This completes the recording processes to the card 6. If there is a subsequent job, the operations described above are repeated.

The following will now describe the effects of the printer apparatus 1 of this embodiment.

The printer apparatus 1 of this embodiment has a discharge tray 2 detachable to the apparatus (casing 7) and that can stack a plurality of cards. The horizontal support surface 22 that supports the bottom surface 2*e* of the discharge tray 2, and an opening 20 demarcated by the vertical engaging surfaces 21*a* to 21*d* that touch each of the touching surfaces 2*a* to 2*d* of the discharge tray 2 are formed in the apparatus. There are no surfaces formed that oppose the vertical engaging surfaces 21*a* to 21*d* and there are no brace members or guide members existing on the right surface side of the opening or in the boundary of the right surface side. Also, a locking mechanism is disposed in the horizontal support surface 22 at the position where the discharge outlet 4 that receives the card 6 from the apparatus is positioned. The locking mechanism configuration includes a convex member 30 that positions and locks the discharge tray 2. For that reason, the discharge tray 2 has a structure that allows it to be detached from the apparatus not only from the front direction and side direction of the apparatus, but also from any direction therebetween (see FIG. 4).

Therefore, with the printer apparatus 1 of this embodiment, the discharge tray 2 is detachable from any direction within a predetermined angle of the opening 20 formed in the apparatus and open continuously, thereby providing the operator with freedom to access the tray. Furthermore, because the discharge tray 2 can be detached from any direction, apparatus cost is reduced because guide members such as rails and the like are eliminated. Damage caused by the apparatus and guide members such as rails and the like, colliding when the tray is inserted, is eliminated.

Also, the printer apparatus 1 of this embodiment has an operation panel 5 that is rotatable within a predetermined angle so the operator may freely access the discharge tray 2 and the operation panel 5 (this is rotatable to positions that enable the operator to easily read the characters and the like displayed on the display unit 40), the range of directions for the apparatus to installed is expanded and convenience is improved.

According to this embodiment of the present invention, a card 6 is used as an example of a recording medium. However, the present invention is not limited thereto and can be applied to a sheet-shaped recording medium. This can be applied to any printer apparatus including copiers and ink jet printers. In such a case, instead of the printing unit 60 and magnetic encoder unit 80, it is acceptable to apply the technologies of known recording and printing methods.

The embodiment above provided an example of the present invention applied to a side of the discharge tray 2, but this is not to be construed as a limitation of the present invention. It can also be applied to a supply tray side. Still further, the positional relationship of the discharge tray 2 and the supply tray 3 described in the embodiment is not to be construed as a limitation.

Figure 12B:
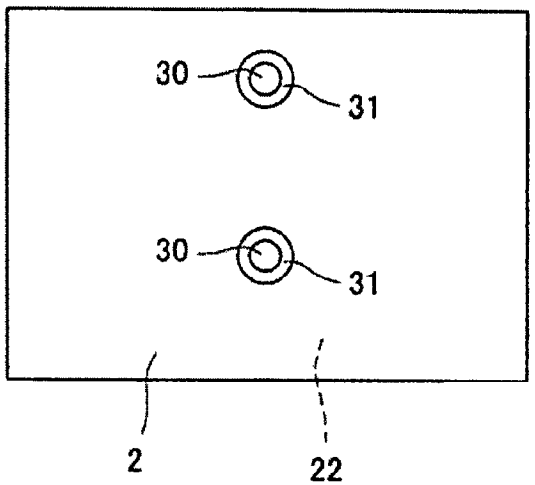
Figure 12A:
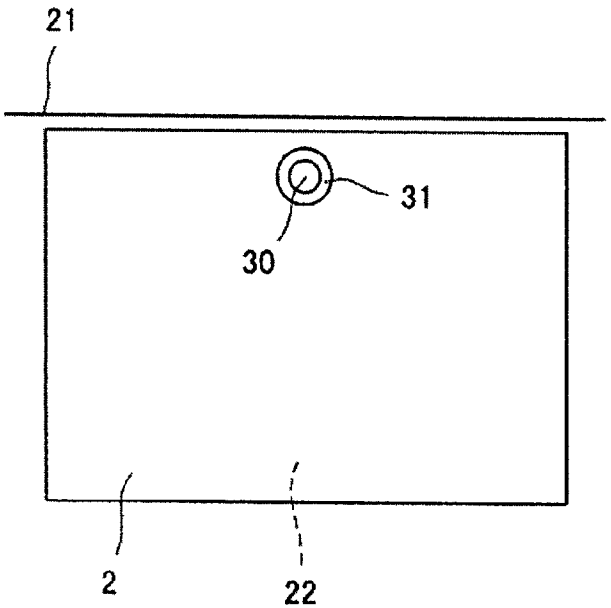

Also, because the locking mechanism of the embodiment is disposed in a corner of the horizontal support surface 22, a plurality of vertical engaging surfaces 21 (at the minimum, the vertical engaging surfaces 21*a* and 21*b*) is necessary. However, for example, as shown in FIG. 12A, if the locking mechanism is disposed in a position that is not a corner, it is possible for one vertical engaging surface 21 to prevent rotation of the discharge tray 2. In such a case, the direction of operator access of the opening 20 for the discharge tray 2 can be expanded to 180°. Also, as shown in FIG. 12B, a plurality of locking mechanism (for example two locking mechanism) can be used to position the discharge tray 2. In such a case, the discharge tray 2 is prevented from rotating by the plurality of locking mechanisms so it is not necessary to prevent rotation of the discharge tray 2 by its touching the vertical engaging surfaces 21.

Therefore, it is acceptable to configure the system so that the touching surface 2 of the discharge tray 2 and vertical engaging surface 21 are opposed or one is omitted. Also, with the present embodiment, an example was provided for the locking mechanism to be disposed in the horizontal support surface 22, but the present invention is not limited thereto. It is also acceptable to dispose it in the vertical engaging surfaces 21 instead of the horizontal support surface 22, and to dispose it in the vertical engaging surfaces 21 in addition to the horizontal support surface 22. In such a case, there can be one or a plurality of locking mechanisms. Essentially, it is acceptable to position and fasten the discharge tray 2 (or the supply tray 3) at an installation position on the horizontal support surface 22 and/or the vertical engaging surface 21. While doing so, it would be preferable if it is possible to eliminate brace and guide members such as rails in the opening 20 to enable the operator to detach the discharge tray 2 from any direction.

Still further, this embodiment provided an example of the locking mechanism having a convex member 30 on the apparatus side and a concave portion 31 disposed on the discharge tray 2 side. However, in order to position the discharge tray 2, the opposite relationship is also perfectly acceptable. Also, an example was provided with this embodiment for a locking mechanism composed of the convex member 30, a spring 34 and a bracket. However, the locking mechanism is not to be construed to be limited to those members. For example, the discharge tray 2 can be positioned by embedding a magnet in either one of the horizontal support surface 22 and discharge tray 2 and embedding a member with magnetic properties such as metal and the like in the other so that the magnet and magnetic member are attracted to each other. In this case, it is not necessary for the locking mechanism to project out from the horizontal support surface 22 so the horizontal support surface 22 can be completely flat. In such a case, it is acceptable to form a concave portion on one and a convex portion on the other.

An example was described in this embodiment of a system configured with the host apparatus, but it is also acceptable to equip the printer apparatus 1 with a media reading unit to read data recorded on an MO, CD or DVD and the like, and to enable operation of the printer apparatus 1 according to recording operation instructions from the operation panel 5. In this embodiment, an example was explained to print using the colors of Y, M, C, and Bk in the printing process at the printing unit 50, but the present invention is not limited thereto and can also print using only Bk. Furthermore, an OP layer (transparent protective layer) can be added to the ink ribbon R to cover the surface of the card C using that transparent protective layer.

This application claims priority from Japanese Patent Application No. 2007-7714 filed on Jan. 17, 2007, which is herein incorporated by reference.

While the invention has been explained with reference to the specific embodiments of the invention, the explanation is illustrative, and the invention is limited only by the appended claims.

What is claimed is:

1. A printer apparatus, comprising:

a casing;

a supply unit formed in the casing to supply recording media one at a time;

a recording unit formed in the casing to record information to the recording media supplied from the supply unit;

a storage unit formed in the casing to store the recording media recorded at the recording unit; and a positioning device formed in the casing, wherein at least one of the supply unit and the storage unit includes a tray to store a plurality of recording media in a stacked state, the tray having a bottom surface and two side surfaces intersecting with each other, and being detachably attached to the casing;

wherein the casing includes a support surface for supporting the bottom surface of the tray, at least two wall surfaces intersecting with each other and opposing to the two side surfaces of the tray, a first lateral side and a second lateral side substantially perpendicular to each other to form a corner, and an opening defined by the support surface and the at least two wall surfaces to place the tray inside the casing, the opening being located at the corner expanding between the first lateral side and the second lateral side so that the tray is freely inserted into or removed from the supply unit or the storage unit not only with each horizontal direction to the first lateral side and the second lateral side, but also with any directions between the first lateral side and the second lateral side through the opening; and wherein the positioning device is disposed in at least one of the support surface and the wall surfaces of the casing for positioning the tray in a proper position inserted through the opening.

2. The printer apparatus according to claim 1, wherein the tray is locked by the positioning device at the proper position to provide or receive the recording media, the tray being prevented from rotating by touching the two wall surfaces.

3. The printer apparatus according to claim 1, wherein the tray is locked at a position to provide or receive the recording media.

4. The printer apparatus according to claim 1, wherein the support surface is substantially flat and smooth, and the two wall surfaces are positioned transverse to the support surface.

5. The printer apparatus according to claim 2, wherein one of the positioning device and tray has a convex portion, and the other has a concave portion, and the tray is locked by the positioning device when the concave portion engages the convex portion.

6. The printer apparatus according to claim 5, wherein the convex portion has a retreated position and a projected position, and is urged by a spring toward the projected position.

7. The printer apparatus according to claim 5, wherein the convex portion has a spherical shape.

8. The printer apparatus according to claim 1, further comprising an operation panel that can rotate within a predetermined angle on the apparatus.

9. The printer apparatus according to claim 1, wherein the storage unit is located under the supply unit and has the tray, the tray having a card discharge outlet for discharging cards as the recording media when the tray is full with the cards.

10. The printer apparatus according to claim 1, wherein one wall surface of the at least two wall surfaces of the casing has a discharge outlet to discharge the recording media, and the bottom surface of the tray is downwardly inclined in a direction away from the discharge outlet such that the recording media from the discharge outlet are aligned in the tray, and the positioning device is disposed close to the wall surface having the discharge outlet.

11. The printer apparatus according to claim 10, wherein one of the positioning device and the tray has a convex portion, a spring urging the convex portion, and a bracket housing the convex portion and the spring; and the other of the positioning and the tray has a concave portion.

12. The printer apparatus according to claim 11, wherein the convex portion has a spherical portion, a flange portion formed around the spherical portion, and a cylinder disposed adjacent to the flange portion, and the bracket includes a cylindrical portion engageable with the flange portion at one end thereof and a fastening portion horizontally extending from the cylindrical portion.

13. A printer apparatus, comprising:

a casing;

a supply unit formed in the casing to supply recording media one at a time;

a recording unit formed in the casing to record information to the recording media supplied from the supply unit;

a storage unit formed in the casing to store the recording media recorded at the recording unit; and a positioning device formed in the casing, wherein at least one of the supply unit and the storage unit includes a tray to store a plurality of recording media in a stacked state, the tray having a bottom surface and two side surfaces intersecting with each other, and being detachably attached to the casing;

wherein the casing includes a support surface for supporting the bottom surface of the tray, two wall surfaces intersecting with each other and opposing to the two side surfaces of the tray, a first lateral side and a second lateral side substantially perpendicular to each other to form a corner, and an opening defined by the support surface and the two wall surfaces to place the tray inside the casing, the opening being located at the corner expanding between the first lateral side and the second lateral side such that the tray is freely inserted into or removed from the supply unit or the storage unit with any directions between the first lateral side and the second lateral side through the opening;

wherein the positioning device is disposed in the support surface of the casing for positioning the tray in a proper position inserted through the opening; and wherein the positioning device has a convex portion and a spring urging the convex portion, and the tray has a concave portion; and when the convex portion engages the concave portion, the convex portion is urged toward the concave portion by the spring to lock the tray in the casing, and when the convex portion contacts an edge of the concave portion, the convex portion is retreated by the edge of the concave portion to release the tray from the casing such that the convex portion is inserted into or removed from the concave portion with any directions on the convex portion.

14. The printer apparatus according to claim 13, wherein one of the two wall surfaces of the casing has a discharge outlet to discharge the media, and the bottom surface of the tray is downwardly inclined in a direction away from the discharge outlet such that the media from the discharge outlet are aligned in the tray, and the positioning device is disposed close to the wall surface having the discharge outlet.

15. The printer apparatus according to claim 14, wherein the positioning device further includes a bracket housing the convex portion and the spring, and the spring urges the convex portion from the bracket.

* * * * *